United States Patent [19]

Terry

[11] 4,273,501

[45] Jun. 16, 1981

[54] ROLL HANDLING DEVICE

[76] Inventor: Melvin D. Terry, P.O. Box 7174, Seattle, Wash. 98133

[21] Appl. No.: 953,914

[22] Filed: Oct. 23, 1978

[51] Int. Cl.[3] ..... B66C 23/00

[52] U.S. Cl. ..... 414/680; 414/530; 180/125

[58] Field of Search ..... 414/680, 684, 538, 24.5, 414/694, 590, 730, 699; 180/116, 125

[56] References Cited

U.S. PATENT DOCUMENTS

| | | | |
|---|---|---|---|
| 3,013,676 | 12/1961 | Daniels | 414/538 |
| 3,251,430 | 5/1966 | Veryzer | 180/125 |
| 3,259,258 | 7/1966 | Fisher | 414/680 |
| 3,268,023 | 8/1966 | Di Napoli, Jr. | 180/125 |
| 3,326,311 | 6/1967 | Jung | 180/125 |

FOREIGN PATENT DOCUMENTS

| | | | |
|---|---|---|---|
| 891917 | 10/1953 | Fed. Rep. of Germany | 414/680 |
| 1046255 | 7/1953 | France | 414/680 |
| 196213 | 5/1965 | Sweden | 414/694 |

*Primary Examiner*—Leslie J. Paperner
*Assistant Examiner*—Lawrence E. Williams
*Attorney, Agent, or Firm*—Cole, Jensen & Puntigam

[57] ABSTRACT

An apparatus for safely transporting a roll of paper or the like and including the capability of lifting it to a stand or removing it therefrom. The apparatus includes roll supporting ramps and a pair of powered, articulated arms and is supported by air bearings. The device includes safety controls whereby the roll cannot be lifted to or from the pair of roll supporting ramps unless the roll is located at approximately the center of gravity and then the roll is moved along a line substantially vertically above the center of gravity.

5 Claims, 3 Drawing Figures

ROLL HANDLING DEVICE

BACKGROUND OF THE INVENTION

The handling of paper rolls or the like during manufacture or further treating process has been a problem. The rolls of paper tend to be large, bulky, and heavy therefore the manufacture and processing has in the past required cranes or specially equipped forklifts to assurproper handling without damage. The utilization of forklifts is somewhat limited in that the space is generally at a premium. The paper making machines are placed closely together eliminating the use of bulky forklift type vehicles in many areas even though a forklift can, in fact, be adapted for handling rolls of paper or the like. Another drawback with respect to the utilization of a forklift exists in the fact that once they are modified to handle bulk rolls their general utility is reduced.

The use of overhead cranes increases danger in the fact that the roll is supported from an overhead position thereby, by definition, lacking precise control as a result of the cable or chain and further tends to be slow and requires elaborate power drive mechanisms or persons of substantial strength to handle the roll.

It is an object of the present invention to provide a mechanism wherein a bulk roll of paper or the like may be easily handled and transported by a person of small stature and little strength.

It is another object of the present invention to provide a device wherein a bulk roll of paper or the like may be picked up from the floor and placed upon an unwinding stand or the like or removed from a raised position and placed upon a floor with little or no effort on the part of the operator.

It is still another object of the present invention to provide a means whereby a roll of paper or the like may be easily transported with very little effort since the entire weight of the roll is supported on an air film.

Still another object of the present invention is to provide a means whereby a roll of paper may be moved from the floor to a stand or vice versa wherein the device handling the roll has infinite maneuverability and safety features which would prevent the inadvertent tipping of the device even though the device is not counterweighted.

Yet another object of the present invention is to provide a roll handling device including articulated arms wherein the operation of the arms is restricted to motions which will not seriously effect stability even though the device is not counterweighted.

DETAILED DESCRIPTION OF THE DRAWINGS

Figure 1:
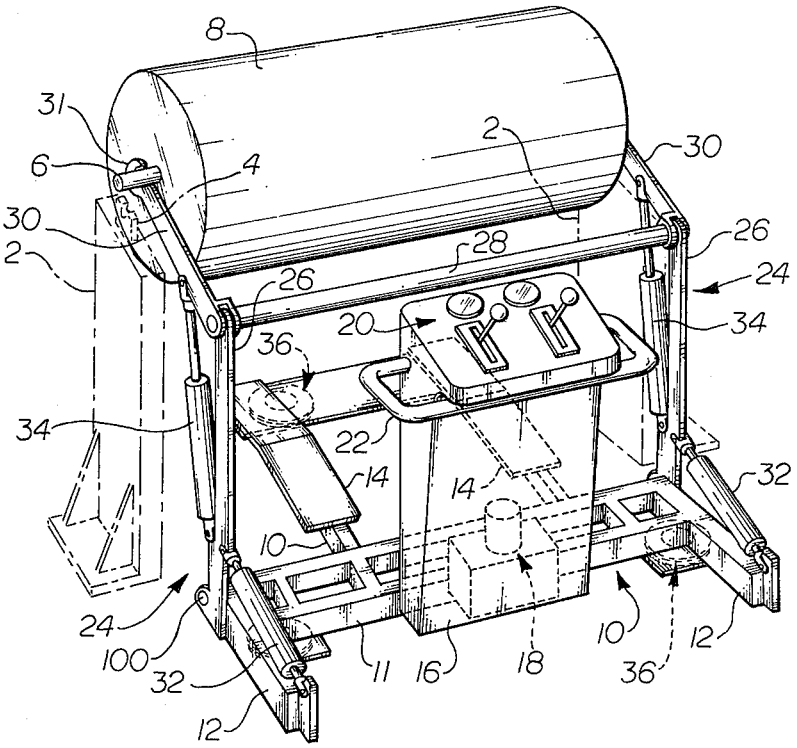
FIG. 1 is an environmental view showing the present invention about to place a roll of paper upon an unwinding stand.

As seen in FIG. 1, the device is shown adjacent an unwinding stand having a pair of vertical uprights 2, each terminating in an upwardly opening shaft receiving support 4, into which will be placed the outwardly projecting ends of shaft 6 which extends through the center of a roll 8 of paper or the like.

The roll handling device which is the subject of the present invention comprises a basic framework 10 having a width of approximately the width of the roll to be handled. The frame for the preferred embodiment includes a main support portion 11. At the outer edges of the main support portion 11 are a pair of rigid extension members 12 which will be described in greater detail hereinafter and which serve as a base for some of the operating elements. Extending in the opposite direction from extension members 12 and intermediate the width of the main frame member 11 are a pair of parallel outwardly extending ramps 14.

Secured to the frame and extending upwardly therefrom at the rear portion of the frame 11 and approximately centered thereon, i.e. that portion opposite the ramps, is an enclosed housing 16 covering the necessary motors and pumps 18 and terminating at the upper portion with a control panel 20. Also secured to the housing 16 is a handle member 22 for moving the device from position to position.

As explained in greater detail hereinafter, the device is supported by air bearings thereby enabling ease of movement whether or not the device is loaded. It is to be understood that the utilization of casters or the like to permit movement of the device when it is in its unloaded condition is certainly with the concept of the present invention.

Rigidly secured to a hollow and pivotal shaft 100 running through the main support frame 11 at opposite sides thereof are articulated arm members 24 which extend generally forwardly and have a first section 26 rigidly secured to shaft 100. The second portions 30 of the articulated arms 24 is pivotally secured to the outer end of sections 26, and rigidly secured to shaft 28 extending the width of the frame and terminate in a hook like portion 31 to support a roll of material by a shaft extending therethrough. For removing a roll and moving it down the ramp, a hook portion including means to close the upper opening may be required for control.

The movement of the articulated arms 24 is controlled by means of ram members 32 and 34 which are respectively secured to sections 28 and 30 as will be explained hereinafter.

Figure 2:
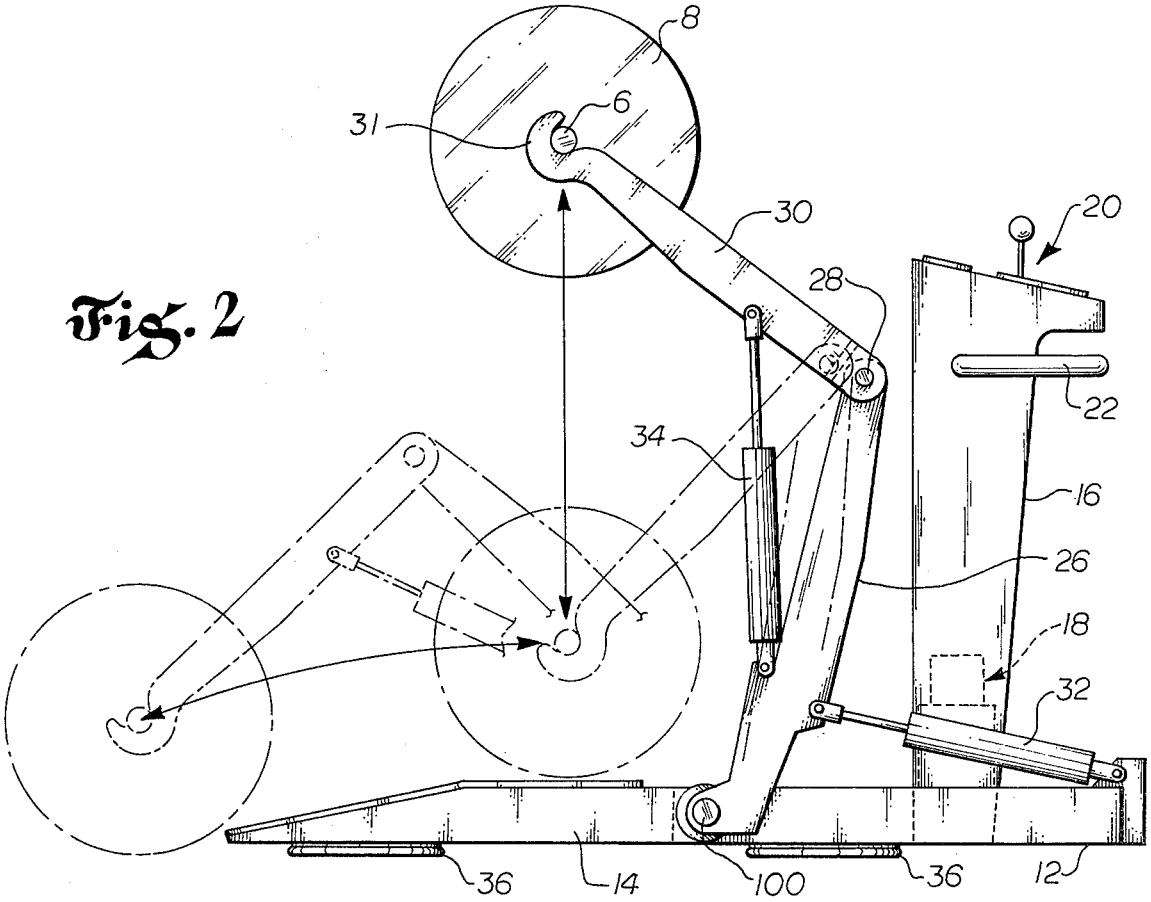
FIG. 2 is a side elevational view showing the apparatus in its elevated position with the other positions shown in phantom.

Referring now to FIG. 2, the various relationships of the elements described hereinabove may more clearly be seen, as well as the various stages of operation as will be described in greater detail with respect to the control circuit. Further to be seen in this view is the fact that the entire apparatus is supported by means of air bearings 36. A bearing is mounted under each of the forwardly extending ramps 14 and two more are located at spaced positions under the main frame portion just forward of the control panel 16. Also seen in this view is the fact that the ram 32 is pivotally secured to the outboard end of rigid extension member 12 and the lower portion of pivoted arm section 26. This ram controls movement of arm section 26 from the upper position, as shown in solid, to the outer or extended position as shown in dotted phantom 4 in picking up a roll of paper or the like and further to the fully retracted position, also shown in phantom. Hydraulic ram 34 which is likewise secured to section 26 but at the opposite side thereof has its cylinder rod connected to the section 30. This ram controls movement of section 30 from that position shown in phantom for picking up a roll to the second position, shown in phantom, wherein the roll has been moved up the ramp and placed adjacent the pivot point for generally upwardly extending arm section 26 to yet a third position shown in solid which is appropriate for placing the roll of paper upon an unwinding stand or the like. The hollow shaft 100 and the other torque tube 28 assure that arms $26^R$ and $26^L$ and arms $30^R$ and $30^L$ work in unison with their respective and opposite hydraulic cylinders.

It is to be understood that although the description of the present invention has dealt primarily with the movement of a roll of paper or the like from a position on the floor to a position on an unwinding stand the device could easily well be used for the reverse operation. The additional requirement for this operation would be that the roll be secured within the hook like outer portion of arm 30 by means of a latch or the like. The use of the latch or the like on the hook portion 31 may, in fact, be desirable in all circumstances to require that an operator assure themselves that the shaft 30 is properly placed in the stand prior to releasing the supporting device.

Figure 3:
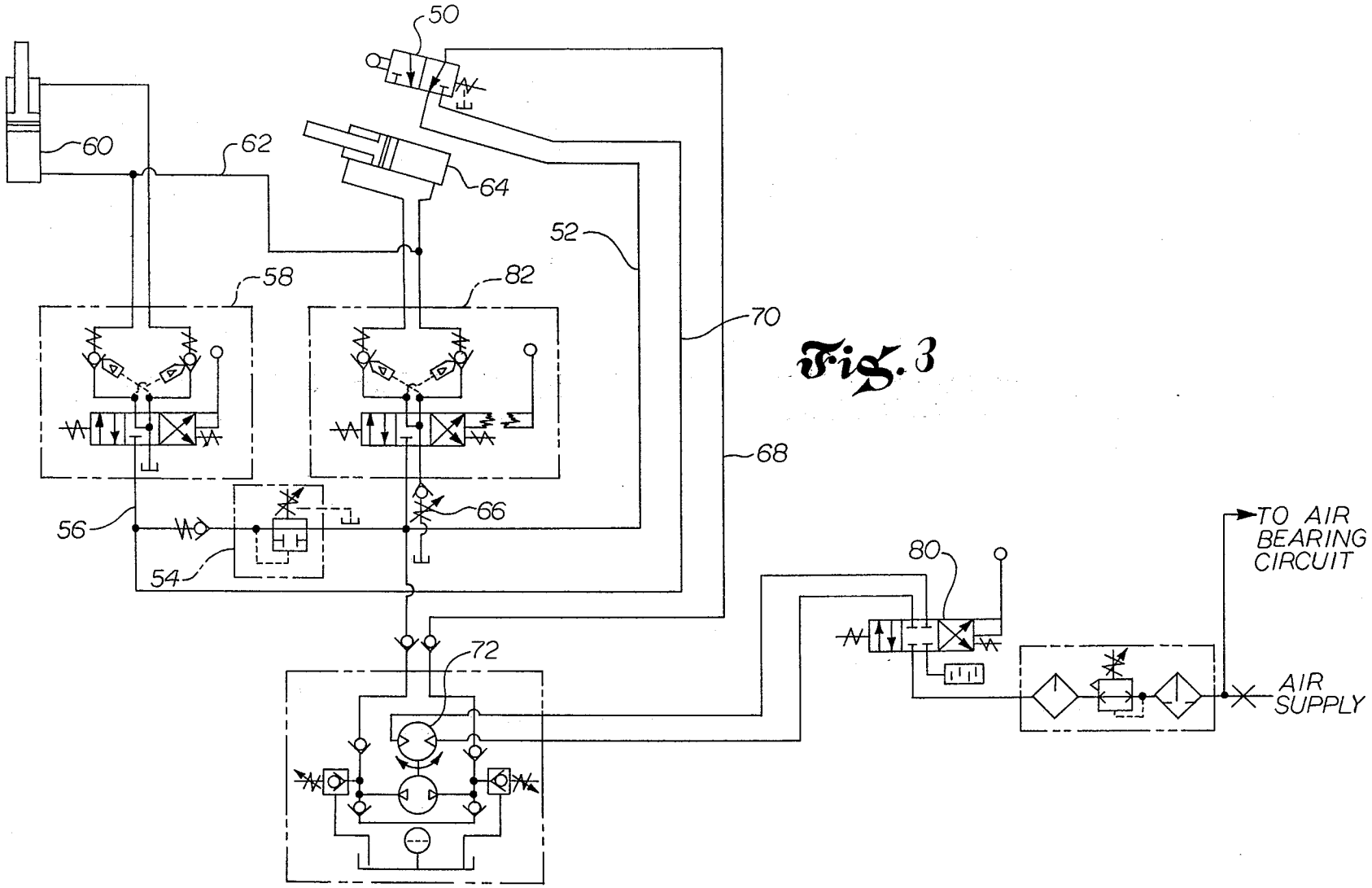
FIG. 3 is a schematic diagram of the control and operation circuitry.

Referring now to the schematic drawing as shown in FIG. 3, the control valve 50 in the upper portion of the schematic directs the oil along line 52, through the pressure reducer valve 54 and then along line 56 through control 58 to the lift and lower cylinder 60. Pressure reducing valve 54 allows adjustment of the lifting bores while the forward arms are extended out over the front of the machine for engaging the roll. The purpose of the pressure reducing valve 54 is to prevent the lifting of a roll while the articulated arm is in the fully extended position and actually prevent such action until the arms are fully retracted and centered over the air bearings. This feature geometrically eliminates the need of a large counterweight such as used with a fork-lift.

An interconnecting line 62 connects the fill side of the lift cylinder 60 and the drain side of extend retract cylinder 64 to provide a bleed back when the weight of the roll exceeds the lift force applied to cylinder 60. The oil is thus rerouted to the tank through a check valve 66. Once the lift cylinder 60 is engaged, the swing of the arm means that mechanically it continually places upward pressure on the roll as the roll is retracted toward the centerline position of the machine. Only cylinder 64 need be activated to cause the roll to be towed up the ramp on the machine.

As the roll tries to follow the mechanical arc created by the retracting cylinder 64 the tendency of the lift cylinder 60 to force the roll to follow that arc is counteracted by the interconnecting line 62. Once the retract cylinder 64 is retracted and has engaged valve 50, i.e. cylinders 60 and 64 are fully retracted and the arm contacts valve 50, the oil under pressure being conducted through line 68 will now be directed through line 70 rather than through 50 and give full lifting force to lift cylinder 60. This circuit bipasses the pressure regulator 54. While valve 50 is in the actuated position the extend retract cylinder 64 is effectively removed from the circuit and cannot again operate until the air motor 72 is reversed and thus has reversed the direction of oil flow. The control circuit as described prevents the operator from lifting the roll, i.e. extend cylinder 60, unless it is over the effective center of gravity of the device. In the preferred embodiment, it has been made difficult for an operator to reverse the motor 72 by means of valve 80 by putting a mechanical spring latch (not shown) on the control console such that the operator must manually release the latch before valve 80 can be activated for the reverse motion.

In general, the sequence of operation is that the operator will approach a roll laying on the floor. Control 58 for the lift cylinder 60 has been placed in a partially raised position cylinder 64 has been extended to valve 82. The articulated arms are now extending forward to near their maximum position as shown in phantom in FIG. 2. By dexterous operation of control valves 82 and 58 the operator brings the hook lever arm into engagement with the roll shaft as control 58 is inactivated until the maximum pressure allowed by pressure reducer valve 54 has been applied. Control 82 is now activated and movement of the retract cylinder 64 draws the roll up the ramp onto the machine. Once the retract cylinder 64 has reached its limit and activated valve 50 full power is now supplied to the lift cylinder 60 and the roll can be lifted to its maximum vertical position.

The air bearings are activated, the machine is levitated on the air bearings and now manually pushed to the paper roll back stand. Cylinder 60 is activated to lower the roll into the bearing pedestals of the back stand then further lowered to clear the shaft. As noted above, it may be desirable to put a mechanical lock on the hooks of the lift arm so that a second step is required to release the shaft from the hooks. Once the operator has cleared the roll he backs the machine out of position. It is to be noted that the machine does not necessarily run on the air bearings when empty but wheel casters for movement of the machine when it doesn't have a load or when there is no air available.

It is well within the scope of this invention to utilize this unit or a variation of this unit as a back stand itself. The device becomes a relatively inexpensive self-loading back stand. The back stand would float on air bearings and pick up the roll, line up in front of the bearings where the hook units are and would simply hold the roll in the elevated position while it unwinds. It is to be understood that the bearings would be deflated and the frame rest on the floor.

What is claimed is:

1. A device for handling rolls of paper or the like, comprising:

main framework means supporting the necessary equipment and controls, said main framework supported by a fluid bearings, a pair of outwardly extending parallel ramp members, each supported by at least one fluid bearing, a pair of articulated arms pivotably secured to the main framework and extending outwardly in a direction generally parallel to the ramp members, said arms including a first section pivotably secured to the frame at opposite sides thereof and extending generally outwardly and upwardly, a second section having a first end pivotably secured to the first section and extending generally outwardly and downwardly to terminate in a material handling second end said arms movable from an extended or reach position to a retracted position and to an upward or lift position, means for selectively moving the arms to the various positions, and means limiting vertical movement of the second end to a plane substantially above and including the center of gravity of the device, whereby the device lifts only when in a stable position.

2. A mechanism for raising, lowering and transporting bulky rolls of paper or the like comprising:

main framework means, supported by air bearings, for use adjacent the supporting surface, including a handle means at a convenient height for a standing person and a pair of oppositely extending rigid ramp members supported by air bearings such that the bearings beneath the frame and the ramp members provide a stable base for the entire mechanism, a pair of substantially parallel articulated arm members pivotally secured to the frame means at opposite sides of the frame means and extending outwardly in the same direction as the ramp members said arm members movable from a first position whereat the outer ends of the arms extend beyond the ends of the ramp means to a second position whereat the outer ends are located in a plane above the center of gravity of the mechanism and slightly above the ramp members and a third position whereat the ends are raised to a position substantially above the ramps but limited to a position vertically above the center of gravity; and means preventing the raising of the arms and a supported load when in any location other than with the outer ends above the center of gravity.

3. A mechanism as in claim 2 wherein the outer ends of the arm members include means for cradling a shaft extending through the roll.

4. A mechanism as in claim 3 wherein the movement of the arms is limited such that the end remain substantially within a vertical plane when moving from position two to position three.

5. A mechanism as in claim 2 wherein the arms are moved hydraulically and unless the end of the arms are substantially within a vertical plane extending through the center of gravity, there is not sufficient pressure to raise a load.

* * * * *